US010202672B2

(12) United States Patent
Ienaga

(10) Patent No.: US 10,202,672 B2
(45) Date of Patent: Feb. 12, 2019

(54) MAGNESIUM CASTING ALLOY AND METHOD OF MANUFACTURING SAME

(71) Applicant: HONDA MOTOR CO., LTD., Tokyo (JP)

(72) Inventor: Yuichi Ienaga, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 97 days.

(21) Appl. No.: 15/154,566

(22) Filed: May 13, 2016

(65) Prior Publication Data

US 2016/0348218 A1 Dec. 1, 2016

(30) Foreign Application Priority Data

May 27, 2015 (JP) ..... 2015-107786

(51) Int. Cl.
*C22C 23/06* (2006.01)
*C22C 23/04* (2006.01)

(52) U.S. Cl.
CPC ..... *C22C 23/06* (2013.01)

(58) Field of Classification Search
CPC ..... C22C 23/06; C22C 23/04
USPC ..... 420/411
See application file for complete search history.

(56) References Cited

U.S. PATENT DOCUMENTS

2005/0002821 A1* 1/2005 Bettles ..... C22C 23/06 420/412
2006/0065332 A1 3/2006 Ienaga et al.
2006/0228249 A1* 10/2006 Lyon ..... C22C 23/06 420/406
2007/0125464 A1* 6/2007 Kawamura ..... C22C 23/04 148/666
2009/0162242 A1 6/2009 Inoue et al.
2015/0013854 A1 1/2015 Kawamura et al.

FOREIGN PATENT DOCUMENTS

JP 3905115 B2 4/2007
JP 2009-144215 A 7/2007
JP 2009-149952 A 7/2009
JP 4500916 B2 7/2010

OTHER PUBLICATIONS

Ienaga et al, "Casting Process and Mechanical Properties of Large-Scale Extruded Mg—Zn Alloys", SAE International Paper, 2013-01-0979, Apr. 8, 2013 (8 Pages).
Kawamura, "Feature and future outlook of LPSO type magnesium alloy", Materia, the Japan Institute of Metals, Feb. 2015, vol. 54, No. 2, pp. 44-49. With partial translation.
Office Action dated Dec. 11, 2018 issued in Japanese applicatoin No. 2015-107786. (3 pages).

* cited by examiner

*Primary Examiner* — Helene Klemanski
(74) *Attorney, Agent, or Firm* — Westerman, Hattori, Daniels & Adrian, LLP

(57) ABSTRACT

A magnesium casting alloy is provided in which unlike an extruded alloy, a large amount of energy and a large cost are not needed for plastic processing, and in which in a high-temperature region of about 200 to 250° C., both mechanical properties and thermal conductivity are achieved. A magnesium casting alloy including Mg, Zn and Y, where a content of Zn is equal to or more than 1.2 atomic % but equal to or less than 4.0 atomic %, a content of Y is equal to or more than 1.2 atomic % but equal to or less than 4.0 atomic %, a composition ratio Zn/Y of Zn to Y is equal to or more than 0.65 but equal to or less than 1.35 and an Mg purity of an Mg mother phase is equal to or more than 97.0%.

23 Claims, 3 Drawing Sheets

50 μm

MAGNESIUM CASTING ALLOY AND METHOD OF MANUFACTURING SAME

This application is based on and claims the benefit of priority from Japanese Patent Application No. 2015-107786, filed on 27 May 2015, the content of which is incorporated herein by reference.

BACKGROUND OF THE INVENTION

Field of the Invention

The present invention relates to a magnesium casting alloy and a method of manufacturing such a magnesium casting alloy.

Related Art

Since magnesium is lighter than iron and aluminum, it is examined to use magnesium as a lightweight alternative material which replaces a member formed of an iron and steel material or an aluminum alloy material. As a magnesium alloy excellent in mechanical properties, casting and the like, AS91D is known.

However, in a general magnesium alloy, mechanical properties such as a tensile strength and creep elongation are lowered in a high-temperature region of about 200 to 250° C., and thus, it is impossible to obtain a high-temperature strength (tensile strength at a high temperature) comparable to a heat-resistant aluminum alloy such as an ADC 12 material or an A4032-T6 material.

Conventionally, as a commercially available magnesium alloy having heat resistance, WE54 is known in which a rare earth such as Y or a misch metal is added to enhance a high-temperature strength.

As a magnesium alloy having a high strength, for example, Patent Document 1 discloses a magnesium alloy which contains, with respect to the total amount, 1 to 4 atomic % of Zn, and 1 to 4.5 atomic % of Y, in which the remaining part is formed of Mg and an inevitable impurity and which is formed by casting and then extruding an Mg alloy where a composition ratio Zn/Y of Zn to Y falls within a range of 0.6 to 1.3. It is disclosed that this magnesium alloy includes an intermetallic compound $Mg_3Y_2Zn_3$ and an $Mg_{12}YZn$ having a long-period structure and has both a high strength and a high ductility at room temperature.

Furthermore, a heat-resistant magnesium alloy is proposed which has a high strength under a high-temperature environment. For example, Non Patent Document 1 discloses that in an extruded material which is formed of an $Mg_{95.8}Zn_2Y_{22}Zr_{0.2}$ alloy, its proof stress ($\sigma_{0.2}$) at 473K (200° C.) is 367 MPa.

Patent Document 2 discloses that in an extruded material which is formed of an Mg—Zn—Y alloy and which is obtained by extruding a cast product having a long-period multilayer structure phase, the hardness and the yield strength of the extruded material are enhanced as compared with the cast product (paragraph [0034]), and that in an extruded material of an Mg alloy formed of $MgS_{97}Zn_1Y_2$, as a result of the measurements of a 0.2% proof stress, a tensile strength and an elongation at a test temperature of 200° C., a proof stress of 367 MPa is acquired (table 2).

Patent Document 3 discloses a heat-resistant magnesium alloy which contains 1 to 3 atomic % of Zn, 1 to 3 atomic % of Y and 0.01 to 0.5 atomic % of Zr and in which Zn/Y fails within a range of 0.6 to 1.3, in which an a-Mg phase and an intermetallic compound $Mg_3Y_2Zn_3$ phase are minutely dispersed and in which a long-period multilayer structure phase is formed in the shape of a three-dimensional mesh. This Mg alloy is manufactured by casting it into a mold and cooling it at a rate of 10 to $10^3$ K/second, and it is disclosed that the Mg alloy has both a high strength and a high ductility under a high-temperature environment of 200 to 250° C.

Patent Document 1: Japanese Patent No. 4500916

Patent Document 2: Japanese Patent No. 3905115

Patent Document 3: Japanese Unexamined Patent Application, Publication No. 2009-149352

Non Patent Document 1: Ienaga et al, "Casting Process and Mechanical of Large-Scale Extruded Mg—Zn—Y alloys", SAE Technical Paper, 2013-01-0979, Apr. 8, 2013)

Non Patent Document 2: Kawamura Yoshihito, "Feature and future outlook of LPSO type magnesium alloy", Materia, the Japan Institute of Metals, February 2015, Vol. 53, No. 2, p. 44-49

SUMMARY OF THE INVENTION

However, a conventional magnesium alloy is not sufficient as the material of a product used under a high-temperature environment. When the conventional magnesium alloy is used, as the material of a high-temperature component, the temperature of the component is excessively increased depending on the environment of the use, and consequently, the mechanical strength of the component is lowered, with the result that an even larger high-temperature strength is needed for the component material. In particular, in an engine member such as an engine block, a high-temperature strength for withstanding, under a high-temper at lire environment, an explosion load in a combustion chamber for a long period of time is required.

The present inventors have focused attention on the fact that since the conventional heat-resistant magnesium alloy cannot acquire sufficient heat dissipation as compared with a heat-resistant aluminum alloy, the temperature of the component is increased to lower the mechanical strength. Hence, in order to enhance the heat dissipation of an Mg alloy, thermal conductivity is examined.

The heat-resistant magnesium alloy WE54 and the magnesium alloy AZ91D described above have a thermal conductivity of 51 to 52 W/m·K, and the thermal conductivity is about half as high as that of the ADC12 material of the heat-resistant aluminum alloy described above.

Patent Document 1 does not disclose the mechanical strength of a magnesium alloy under a high-temperature environment. Although the magnesium alloy of Non Patent Document 1 has a satisfactory high-temperature strength, its thermal conductivity at room temperature is 72.3 W/m·K (FIG. 5 and table 3 of Non Patent Document 1), and hence its heat dissipation is not sufficient as the heat dissipation of a component material used under a high-temperature environment. In the extruded material of the Mg alloy formed of $Mg_{97}Zn_1Y_2$ disclosed in Patent Document 2, the 0.2% proof stress is lowered to 215 MPa at 250° C., and thermal conductivity is not disclosed.

Furthermore, both the magnesium alloys of Non Patent Document 1 and Patent Document 2 are the extruded materials that are extruded after being cast. In the mechanical properties of an Mg—Zn—Y-based extruded alloy shown in table 1 of Patent Document 2, the Mg—Zn—Y-based alloy of a cast material (comparative example 10) is much lower in tensile strength than the Mg—Zn—Y-based alloy of the extruded material (example).

FIG. 5 is FIG. 4 of Non Patent Document 2, and shows variations in the stress and distortion of the extruded material and the as-cast material of a LPSO (long-period multilayer structure phase) type magnesium alloy formed of $Mg_{97}Zn_1Y_2$. It is found from FIG. 5 that the extruded material has a higher strength than the as-cast material. The present inventors have inferred that this is because in the as-cast material whose cooling rate is low, the long-period multilayer structure phase is not continuously crystallized in the shape of a network but is divided and brought into a crystallized state.

Hence, Patent Document 3 proposes, as a cast material formed of an Mg—Zn—Y-based alloy, a heat-resistant magnesium alloy having both a high strength and a high ductility under a high-temperature environment. However, Patent Document 3 does not disclose thermal conductivity, and an issue of enhancing the heat dissipation of a component used under a high-temperature environment is not recognized.

As described above, in the environment of the use in which the temperature of the component is excessively increased, the mechanical strength of the component is lowered. In particular, engine members such as a piston, a cylinder and an engine block are used under a high-temperature environment. Hence, in a heat-resistant magnesium alloy used in an engine member, it is effective not only to have a high strength and a high ductility in a high-temperature region but also to have a high heat dissipation for reducing an increase in temperature so as to maintain such mechanical properties.

Conventionally, a heat-resistant magnesium alloy that achieves both a high high-temperature strength and a high thermal conductivity is not known. As described above, the engine member needs to withstand an explosion load within a high-temperature combustion chamber. Furthermore, an engine component using a magnesium alloy also has such heat dissipation as to appropriately maintain the temperature of the combustion chamber, and thus it is possible to realize weight saving and the enhancement of fuel efficiency.

Hence, the present invention has an object to provide a heat-resistant magnesium casting alloy that achieves both satisfactory mechanical properties and thermal conductivity in a high-temperature region of about 200 to 250° C.

In view of the problem described above, the present inventors have performed thorough examinations. Consequently, they has found that in a crystal grain boundary around an Mg mother phase, the long-period multilayer structure phase of $Mg_{12}ZnY$ is formed in the shape of a three-dimensional mesh to enhance a high-temperature strength, a structure containing the Mg mother phase of a high Mg purity is formed to achieve a high thermal conductivity and thus it is possible to obtain a heat-resistant magnesium casting alloy which achieves both a satisfactory mechanical properties and a thermal conductivity in a high-temperature region, with the result that the present invention is completed.

Contents of Zn and Y in the magnesium alloy and a composition ratio Zn/Y of Zn to Y are made to fall within specific ranges, and thus in the crystal grain boundary around the Mg mother phase, the long-period multilayer structure phase of $Mg_{12}ZnY$ is formed in the shape of a three-dimensional mesh. The long-period multilayer structure phase in the shape of a three-dimensional mesh serves as a skeleton for enhancing the strength of the magnesium alloy, and thus it is possible to obtain a satisfactory high-temperature creep characteristic. Furthermore, the Zn/Y described above is made to fall within the specific range, and thus Zn or Y which is solid-soluble in the Mg mother phase can be reduced, with the result that it is possible to maintain a high Mg purity of the Mg mother phase. In this way, it is possible to obtain a heat-resistant magnesium casting alloy having a high thermal conductivity.

Specifically, the present invention provides the followings.

(1) A magnesium casting alloy including Mg, Zn and Y, where a content of Zn is equal to or more than 1.2 atomic % but equal to or less than 4.0 atomic %, a content of Y is equal to or more than 1.2 atomic % but equal to or less than 4.0 atomic %, a composition ratio Zn/Y of Zn to Y is equal to or more than 0.65 but equal to or less than 1.35 and an Mg purity of an Mg mother phase is equal to or more than 97.0%.

(2) A magnesium casting alloy including Mg, Zn and Y, where a content of Zn is equal to or more than 1.2 atomic % but equal to or less than 4.0 atomic %, a content of Y is equal to or more than 1.2 atomic % but equal to or less than 4.0 atomic %, a composition ratio Zn/Y of Zn to Y is equal to or more than 0.65 but equal to or less than 1.35, a thermal conductivity is equal to or more than 80.0 W/m·K and a tensile strength at 200° C. is equal to or more than 200 Mpa.

(3) A magnesium casting alloy including Mg, Zn and Y, where a content of Zn is equal to or more than 3.0 atomic % but equal to or less than 4.0 atomic %, a content of Y is equal to or more than 3.0 atomic % but equal to or less than 4.0 atomic % and a composition ratio Zn/Y of Zn to Y is more than 0.75 but equal to or less than 1.35.

(4) The magnesium casting alloy according to (3), where a thermal conductivity is equal to or more than 80.0 W/m·K.

(5) The magnesium casting alloy according to (3) where a tensile strength at 200° C. is equal to or more than 200 MPa.

(6) The magnesium casting alloy according to (1), further including 0.01 atomic % or more but 0.3 atomic % or less of Zr.

(7) The magnesium casting alloy according to (2), further including 0.01 atomic % or more but 0.3 atomic % or less of Zr.

(8) The magnesium casting alloy according to (3), further including 0.01 atomic % or more but 0.3 atomic % or less of Zr.

(9) The magnesium casting alloy according to (1), where a long-period multilayer structure phase of $Mg_{12}ZnY$ is formed in a shape of a three-dimensional mesh.

(10) The magnesium casting alloy according to (2), where a long-period multilayer structure phase of $Mg_{12}ZnY$ is formed in a shape of a three-dimensional mesh.

(11) The magnesium casting alloy according to (3), where a long-period multilayer structure phase of $Mg_{12}ZnY$ is formed in a shape of a three-dimensional mesh.

(12) The magnesium casting alloy according to (1), where a specific gravity is equal to or less than 2.10.

(13) The magnesium casting alloy according to (2), where a specific gravity is equal to or less than 2.10.

(14) The magnesium casting alloy according to (3), where a specific gravity is equal to or less than 2.10.

(15) A method of manufacturing the magnesium casting alloy according to (1), the method including:

cooling a molten metal material at a rate which is equal to or more than 20 K/second but equal to or less than 200 K/second.

(16) A method of manufacturing the magnesium casting alloy according to (2), the method including:

cooling a molten metal material at a rate which is equal to or more than 20 K/second but equal to or less than 200 K/second.

(17) A method of manufacturing the magnesium casting alloy according to (3), the method including:

cooling a molten metal material at a rate which is equal to or more than 20 K/second but equal to or less than 200 K/second.

(18) An engine member including the magnesium casting alloy according to (1).

(19) An engine member including the magnesium casting alloy according to (2).

(20) An engine member including the magnesium casting alloy according to (3).

In the present invention, it is possible to obtain a heat-resistant magnesium casting alloy that achieves both satisfactory mechanical properties and thermal conductivity in a high-temperature region of about 200 to 250° C. Hence, it is possible to provide a lightweight, high-strength material that is suitable for use under a high-temperature environment such as an engine member. In this way, it is possible to realize weight saving and the enhancement of fuel efficiency in an engine of an automobile or the like. The magnesium alloy of the present invention has a satisfactory heat dissipation. Thus, it is possible to appropriately maintain the temperature of components of an engine or the like, to appropriately maintain a clearance between components caused by thermal expansion and to prevent the occurrence of a failure in the components. The magnesium alloy of the present invention is manufactured as a cast alloy such as an extruded alloy in which plastic processing is not performed. Hence, the manufacturing cost of the magnesium alloy is reduced, and it is possible to provide a heat-resistant magnesium alloy which is inexpensive as compared with a conventional magnesium alloy.

BRIEF DESCRIPTION OF THE DRAWINGS

FIG. 4A shows the metal structure in example 3, FIG. 4B shows the metal structure in example 4 and FIG. 4C shows the metal structure in example 5.

DETAILED DESCRIPTION OF THE INVENTION

Figure 1:
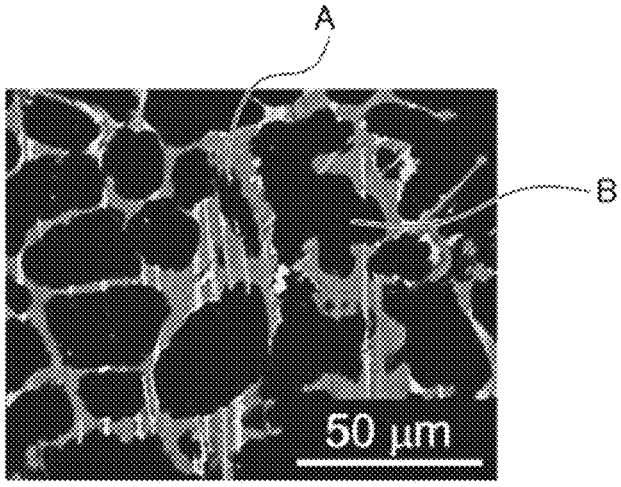
FIG. 1 is an electron micrograph showing the metal structure of a casting magnesium alloy in example 1.

A preferred embodiment of the present invention will be described below. The present invention should not be interpreted to be limited by the embodiment.

The magnesium casting alloy of the present embodiment, is a heat-resistant magnesium casting alloy which contains 1.2 atomic % or more but 4.0 atomic % or less of Zn and 1.2 atomic % or more but 4.0 atomic % or less of Y, in which the remaining part is formed of Mg and an inevitable impurity, in which a composition ratio Zn/Y of Zn to Y is 0.65 or more but 1.35 or less and in which the Mg purity of an Mg mother phase is 97% or more, which is excellent in thermal conductivity and which is used for an engine member.

(Alloy Composition)

Zn and Y are elements that are necessary to form a long-period multilayer structure phase of $Mg_{12}ZnY$ which functions as a strengthening phase for enhancing a mechanical strength in the metal structure of the magnesium casting alloy. The $Mg_{12}ZnY$ phase is formed by adding predetermined amounts of Zn and Y. Preferably, when 1.2% or more of Zn and Y is contained, it is possible to obtain a tensile strength of 200 MPa or more at 200° C. More preferably, 2.0% or more is contained. On the other hand, even when the content of each of Zn and Y is increased, the increase in the tensile strength tends to be saturated, and it is necessary to increase, according to the composition ratio Zn/Y, the content of Y which is expensive. Hence, the content of each of Zn and Y is preferably 4.0% or less.

Since the constituent ratio of Zn to Y in the long-period multilayer structure phase of $Mg_{12}ZnY$ is 1:1, as Zn/Y is closer to 1, the amount of Zn or Y which is solid-soluble in the Mg mother phase is decreased. In this way, since the purity of the Mg mother phase is maintained to be high, it is possible to obtain a high thermal conductivity. On the other hand, when Zn/Y is less than 0.65 or more than 1.35, the amount of Zn or Y which is solid-soluble in the Mg mother phase is increased. In this way, since the Mg purity of the Mg mother phase is lowered, the thermal conductivity is reduced. Hence, Zn/Y is preferably 0.65 or more but 1.35 or less. More preferably, its lower limit value is 0.9 or more, and its upper limit value is 1.10 or less and is particularly preferably 1.0.

An inevitable impurity may be contained as long as it does not affect the properties of the heat-resistant magnesium casting alloy in the present embodiment. For example, 0.5 atomic. % or less of each of Al, Si and the like can be contained as a permissible amount.

The Mg purity of the Mg mother phase in the present embodiment means a content, of Mg in the crystal grains of the metal structure of the magnesium casting alloy. In the heat-resistant magnesium casting alloy according to the present embodiment, the mixed ingredients other than Al are elements which are lower in thermal conductivity than Mg. Hence, as the Mg purity of the Mg mother phase is increased, the thermal conductivity of the magnesium casting alloy is enhanced. On the other hand, when the ingredients other than Mg are solid-soluble in the Mg mother phase, and thus the Mg purity is lowered, the thermal conductivity of the magnesium casting alloy is also lowered. Preferably, when the Mg purity of the Mg mother phase is 97% or more, it is possible to obtain a thermal conductivity of 80.0 W/m·K or more. More preferably, the Mg purity is 99.0% or more.

The heat-resistant magnesium casting alloy according to the present, embodiment has a skeleton in which the long-period multilayer structure phase of $Mg_{12}ZnY$ is formed in the shape of a three-dimensional mesh. In the process of injecting the molten metal into a mold, the network structure of the long-period multilayer structure phase is formed in a crystal grain boundary by Mg, Zn and Y. The structure of the $Mg_{12}ZnY$ phase enhances the tensile strength of the magnesium casting alloy at a high temperature. FIG. 1 is an electron micrograph showing the metal structure of a casting magnesium alloy in example 1. As shown in FIG. 1, the strengthening phase A formed with the long-period multilayer structure phase of $Mg_{12}ZnY$ is formed along the crystal grain boundary around the Mg mother phase B in the shape of a three-dimensional mesh.

Zr is an element that has an effect of reducing the size of the crystal grain and that further enhances the high-temperature strength of the magnesium casting alloy. Hence, the magnesium casting alloy may contain 0.01 atomic % or more but 0.3 atomic % or less of Zr, and preferably contains 0.2 atomic % or more but 0.3 atomic % or less of Zr. When the high-temperature strength of the magnesium casting alloy is sufficient, the content of Zr may be less than 0.01%. When the high-temperature strength of the magnesium casting alloy is further increased, the content of Zr may be more than 0.3%.

Figure 2:
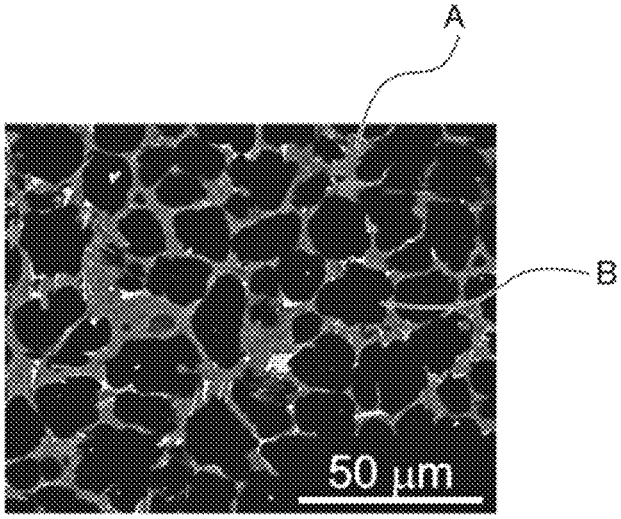
FIG. 2 is an electron micrograph showing the metal structure of a casting magnesium alloy in example 3.

FIG. 2 is an electron micrograph showing the metal structure of a casting magnesium alloy in example 3. In example 3 (FIG. 2) where Zr is contained, as compared with example 1 (FIG. 1) where Zr is not contained, the size of the Mg mother phase B is reduced, and the high-temperature strength is enhanced.

(Thermal Conductivity)

A conventional commercially available magnesium alloy (WE54, AZ91B) has a thermal conductivity of 51 to 52 W/m·K, and the thermal conductivity is about half as high as the thermal conductivity (92 W/m·K) of an aluminum alloy (ADC12 material). Hence, it is impossible to acquire sufficient heat dissipation as the material of a high-temperature component. By contrast, the magnesium casting alloy according to the present embodiment has a high thermal conductivity of 80.0 W/m·K or more, and since it has sufficient heat dissipation as the material of a high-temperature component, it is suitable as a heat-resistant magnesium casting alloy for an engine member. The thermal conductivity is more preferably 90 W/m·K or more. When the magnesium casting alloy according to the present embodiment has predetermined heat dissipation, the thermal conductivity may be less than 80.0 W/m·K.

(Tensile Strength)

In a general magnesium alloy, in a high-temperature region of 200 to 250° C., mechanical properties such as a tensile strength and elongation are lowered, and thus it is impossible to obtain a high-temperature strength comparable to a heat-resistant aluminum alloy (such as the ADC12 material or an A4032-T6 material). By contrast, in the magnesium casting alloy according to the present embodiment, the tensile strength at 200° C. preferably has a high-temperature strength of 200 MPa or more. Hence, it is suitable as a heat-resistant magnesium casting alloy for an engine member used under a high-temperature environment. The tensile strength at 200° C. is more preferably 240 MPa or more. For example, when the magnesium alloy is not used for an engine member used under a high-temperature environment, the tensile strength at 200° C. may be less than 2.00 MPa.

Figure 3:
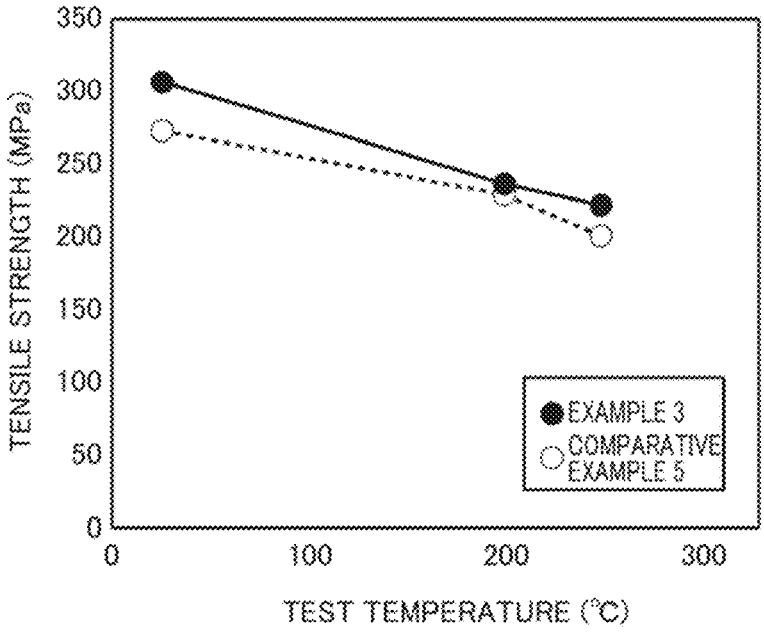
FIG. 3 is a graph showing variations in the tensile strength of the casting magnesium alloys in example 3 and comparative example 5 from, room temperature to 250° C.

Preferably, when the tensile strength at 250° C. is 175 MPa or more, the magnesium alloy is more suitable for an engine member used under a high-temperature environment. FIG. 3 is a graph showing variations in the tensile strength of the casting magnesium alloys in example 3 and comparative example 5 from room temperature to 250° C. As shown in FIG. 3, the magnesium casting alloy in example 3, which is the present embodiment, has a high tensile strength of 200 MPa or more in a high-temperature region of 200 to 250° C. For example, when the magnesium alloy is not used for an engine member used under a high-temperature environment, the tensile strength at 250° C. may be less than 175 MPa.

(Specific Gravity)

As the specific gravity of the magnesium alloy according to the present embodiment is lowered, the magnesium alloy is more suitable for a lightweight component, with the result that the specific gravity is preferably 2.10 or less. The specific gravity may be 2.00 or less or may be 1.90 or less. For example, in an application in which emphasis is not placed on weight reduction, the specific gravity of the magnesium alloy may exceed 2.10.

Preferably, the magnesium casting alloy according to the present embodiment contains 1.2 atomic % or more but 4.0 atomic % or less of Zn and 1.2 atomic % or more but 4.0 atomic % or less of Y, the remaining part is formed of Mg and an inevitable impurity, the composition ratio Zn/Y of Zn to Y is 0.65 or more but 1.35 or less, the thermal conductivity is 80.0 W/m·K or more and the tensile strength at 200° C. is 200 MPa or more. The contents of Zn and Y fail within the ranges described above, and thus the long-period multilayer structure phase of $Mg_{12}ZnY$ is formed in the shape of a three-dimensional mesh around the Mg mother phase and the ingredient which is solid-soluble in the Mg mother phase is reduced, with the result that the Mg purity of the Mg mother phase can be maintained to be high. Thus, it is possible to obtain the heat-resistant magnesium casting alloy that has both a satisfactory thermal conductivity and a tensile strength under a high-temperature environment and that is suitable for an engine member used under a high-temperature environment. The preferable ranges described above can foe applied as necessary to the ranges of the values of the composition.

Preferably, the magnesium casting alloy according to the present embodiment contains more than 3.0 atomic % but 4.0 atomic % or less of Zn and more than 3.0 atomic % but 4.0 atomic % or less of Y, the remaining part is formed of Mg and an inevitable impurity and the composition ratio Zn/Y of Zn to Y is more than 0.75 but 1.35 or less. Since the contents of Zn and Y are more than 3.0%, the width of the long-period multilayer structure phase of $Mg_{12}ZnY$ is formed so as to be large, with the result that the high-temperature strength is easily enhanced. Since a difference between the contents of Zn and Y is small, the ingredient which is solid-soluble in the Mg mother phase is easily reduced, with the result that the Mg purity of the Mg mother phase is easily maintained to be high. Hence, the magnesium casting alloy of the present embodiment becomes a magnesium casting alloy that has both a thermal conductivity and a tensile strength under a high-temperature environment, and thereby can be used as a heat-resistant magnesium casting alloy. The preferable ranges described above can be applied as necessary to the ranges of the values of the composition.

Preferably, the magnesium casting alloy according to the present embodiment contains more than 3.0 atomic % but 4.0 atomic % or less of En and more than 3.0 atomic % but 4.0 atomic % or less of Y, the remaining part is formed of Mg and an inevitable impurity, the thermal conductivity is 80.0 W/m·K or more and the tensile strength at 200° C. is 200 MPa or more. Since the contents of Zn and Y are more than 3.0%, the width of the long-period multilayer structure phase of $Mg_{12}ZnY$ is formed so as to be large, with the result that the high-temperature strength is easily enhanced. Since a difference between the contents of Zn and Y is small, the ingredient which is solid-soluble in the Mg mother phase is easily reduced, with the result that the Mg purity of the Mg mother-phase is easily maintained to be high. Hence, the magnesium casting alloy of the present embodiment becomes a magnesium casting alloy that has both a thermal conductivity and a tensile strength under a high-temperature environment, and thereby can be used as a heat-resistant magnesium casting alloy. The preferable ranges described above can be applied as necessary to the ranges of the values of the composition.

Preferably, the magnesium casting alloy according to the present embodiment contains more than 3.0 atomic % but 4.0 atomic % or less of En and more than 3.0 atomic % but 4.0 atomic % or less of Y, the remaining part is formed of Mg and an inevitable impurity and the magnesium casting alloy according to the present embodiment is a magnesium casting alloy in which the long-period multilayer structure phase of $Mg_{12}ZnY$ is formed in the shape of a three-dimensional mesh. Since the contents of Zn and Y are more than 3.0%, the width of the long-period multilayer structure phase of $Mg_{12}ZnY$ is formed so as to be large, with the result that the high-temperature strength is easily enhanced. Since a difference between the contents of Zn and Y is small, the ingredient which is solid-soluble in the Mg mother phase is easily reduced, with the result that the Mg purity of the Mg mother phase is easily maintained to be high. Hence, the magnesium casting alloy of the present embodiment becomes a magnesium casting alloy that has both a thermal conductivity and a tensile strength under a high-temperature environment, and thereby can be used as a heat-resistant magnesium casting alloy. The preferable ranges described above can be applied as necessary to the ranges of the values of the composition.

(Manufacturing Method)

In order to manufacture the magnesium casting alloy according to the present embodiment, a metal material may be melted at a high temperature in which the metal material contains 1-2 atomic % or more but 4.0 atomic % or less of Zn and 1.2 atomic % or more but 4.0 atomic % or less of Y, the remaining part is formed of Mg and an inevitable impurity and the composition ratio Zn/Y of Zn to Y is 0.65 or more but 1.35 or less. Preferably, as for the process of melting the metal material at a high temperature, for example, the metal material is inserted into a graphite crucible, high-frequency induction melting is performed in an atmosphere of Ar and the metal material is melted at a temperature of 750 to 850° C.

The molten alloy obtained is preferably cast by being injected into a mold. In the process of the casting, the molten metal material is preferably cooled at a predetermined rate. The cooling rate is preferably 20 K/second or more. When the cooling rate is 20 K/second or more, there is a tendency that the particles of the Mg mother phase and the $Mg_3Y_2Zn_3$ phase of an intermetallic compound are unlikely to become coarse, and the network form of the long-period multilayer structure phase of $Mg_{12}ZnY$ is unlikely to be collapsed. The cooling rate is preferably 200 K/second or less. When the cooling rate is 200 K/second or less, in the coagulation of the Mg mother phase, a sufficient time is taken in which solid solution elements within the mother phase are discharged into a crystallized phase (crystal grain boundary), and thus the solid solution elements are unlikely to be left in the Mg mother phase. The cooling rate is more preferably 30 K/second or more but 190 K/second or less, and is further preferably 40 K/second or more but 180 K/second or less. When the particles of the Mg mother phase and the $Mg_3Y_2Zn_3$ phase of an internetallic compound become coarse in an allowable range, and the network form of the long-period multilayer structure phase of $Mg_{12}ZnY$ is in an allowable range, the cooling rate may be less than 20 K/second. When the amount of solid solution element into the Mg mother phase is in an allowable range, the cooling rate may exceed 200 k/second.

(Application)

The magnesium casting alloy according to the present embodiment can be applied to a lightweight component, such as an engine block or a piston, in which a high-temperature strength is required, and since it has a lower specific gravity than a conventional aluminum alloy engine component, it is possible to reduce its weight by 30% or more. It is possible to reduce an increase in the temperature of an engine member and the thermal expansion thereof, to optimize the clearance of a piston or a cylinder and to contribute to the enhancement of fuel efficiency and the quietness of an engine. Furthermore, it is possible to manufacture the magnesium casting alloy as an as-cast material without adding thermal processing and to increase the strength thereof, with the result that it is possible to manufacture it inexpensively as compared with a conventional magnesium alloy.

EXAMPLES

The present invention will be specifically described below based on examples. The present invention should not be interpreted to be limited by the examples.

Example 1

A metal material obtained by adding, to Mg, 2 atomic % of Zn and 2 atomic % of Y was inserted into a graphite crucible, high-frequency induction melting was performed in an atmosphere of Ar and the metal material was melted at a temperature of 750 to 850° C. The molten alloy obtained was injected into a mold and was cast. At the time of the casting, the molten metal material was cooled. The size of the plate-shaped cast alloy obtained by the casting was 50 ram in width and 8 mm in thickness. When an Al—Cu eutectic alloy in which a relationship between a cooling rate and a dendrite secondary arm space was known was cast under the same conditions as in the example of the present application, and the cooling rate was analogized from the secondary arm space, the cooling rate was 55K/second.

Example 2-7, Comparative Example 1-7

Except that the composition was changed according to table 1, the melting and the casting were performed as in example 1, and thus magnesium alloys were manufactured. In comparative examples 5 to 7, literature values were used, and the composition ratios were as follows.

Comparative Example 5 (Aluminum Alloy ADC12)

1.93% of Cu, 10.5% of Si, 0.21% of Mg, 0.82% of Zn, 0.84% of Fe, 0.32% of Mn and the remaining part of Al.

Comparative Example 6 (Magnesium Alloy AZ91D)

9.23% of Al, 0.78% of Zn, 0.31% of Mn and the remaining part of Mg.

Comparative Example 7 (Magnesium Alloy WE54)

5.23% of Y, 1.54% of RE, 1.78% of Kd, 0.51% of Zr and the remaining part of Mg.

Test specimens were cut out of the cast alloys of examples 1 to 7 and comparative examples 1 to 4 for individual measurements, and the following measurements were performed. The results of the measurements are shown in table 1.

(Thermally Conductivity)

The measurements were performed as follows based on JIS R 1611 by a laser flash method.

1) In order to enhance the absorption and the emissivity of heat, a blackening material (carbon spray) was applied to the front and rear surfaces of the casting alloy sample.

2) Pulse laser light was applied to the surface of the sample.

3) A temperature history curve in which the sample temperature was increased Cp with time and was decreased again was obtained.

4) According to the following formula (1), a specific heat capacity Cp was determined from the reciprocal of a temperature increase amount θm.

$$Cp=Q/(M\cdot\theta m) \quad \text{formula (1)}$$

(Q : amount of heat input (pulse light energy), M: mass of the sample)

5) According to the following formula (2), a thermal diffusivity α was determined from a time $t_{1/2}$ which was needed such that the temperature was increased only by a half of the temperature increase amount.

$$\alpha=0.1388d^2/t_{1/2} \quad \text{formula (2)}$$

(d=thickness of the specimen)

6) According to the following formula (3), a thermal conductivity λ was determined from the specific heat capacity Cp, the thermal diffusivity α and the density ρ of the specimen.

$$\lambda=\alpha\cdot Cp\cdot\rho \quad \text{formula (3)}$$

A measurement device and measurement conditions used in the measurement of the thermal conductivity are as follows.

Measurement device: TC7000 model made by ULVAC-RIKO Inc.

Laser pulse width: 0.4 ms

Laser pulse energy: 10 joule/pulse or more

Laser wavelength: 1.06 μm (Nd glass laser)

Laser beam diameter: 10ϕ

Temperature measurement method: infrared sensor (thermal diffusivity measurement) and thermocouple (specific heat capacity measurement)

Measurement temperature range: room temperature to 1400° C. (simultaneous measurements on the specific heat capacity were performed up to 800° C.)

Measurement atmosphere: vacuum

Sample: diameter of 10 mm and thickness of 2.0 mm (Tensile Strength)

The tensile strength was measured as follows.

A tensile test specimen was formed in the shape of an ASTM E8 standard specimen having a parallel portion diameter of 6.35 mm and a reference point interval distance of 25.4 mm. The specimen was heated with a high-frequency heating coil to a test temperature and was then retained for 30 minutes, the temperature was stabilized and thereafter the test was performed.

The test conditions were as follows.

Distortion rate: $5\times10^{-4}$/sec

Test temperature: 200±2° C. (partially 250±2° C.)

(Mg purity of Mg mother phase)

With the following measurement device and measurement conditions, the Mg mother phase of each sample was observed with an electronic microscope, the composition of the Mg mother phase portion was measured at five points by point analysis and the average value thereof (the mass % of Mg) was used as the mother phase Mg purity.

Measurement device: JSM-7100 model scanning electron microscope made by JEOL Ltd.

: JED-2300 model energy dispersive X-ray analyzer made by JEOL Ltd.

Acceleration voltage: 15 kV

Observation field: 400 times (Network Structure Form)

The metal structure of each sample was analyzed by an electron beam backscatter diffraction method (EBSD method), and the length L1 of a crystal grain boundary and the length L2 of the $Mg_{12}ZnY$ phase of a long-period multilayer structure phase were measured by image processing. A measurement region was a region of about 300 μm×200 μm in the cross section of the center portion of the casting alloy which was the sample, was magnified 400 times and was measured. A network formation rate was calculated by L2/L1×100, and evaluation was performed with criteria A to C below.

A: satisfactory network formation (80% or more)

B: network formation was partially divided (50 to 79%)

C: network formation was divided (less than 50%)

(Specific Gravity)

The specific gravity of each sample was measured with a specific gravity measurement method by a liquid weighing method (Archimedes method) specified by JIS S 8807.

TABLE 1

| | | Composition of each alloy (atomic %) | Alloy form | Zn/Y | Thermal conductivity (W/m · K) | Tensile strength (MPa, 200° C.) | Network structure form | Specific gravity |
|---|---|---|---|---|---|---|---|---|
| Example | 1 | Mg98Zn2Y2 | Casting alloy | 1.0 | 92.1 | 222 | A | 1.9 |
| Example | 2 | Mg98.8Zn1.5Y1.5Zr0.2 | Casting alloy | 1.0 | 93.8 | 230 | A | 1.80 |
| Example | 3 | Mg95.8Zn2Y2Zr0.2 | Casting alloy | 1.0 | 92.5 | 240 | A | 1.9 |
| Example | 4 | Mg93.8Zn3Y3Zr0.2 | Casting alloy | 1.0 | 91.8 | 268 | A | 2.01 |
| Example | 5 | Mg91.8Zn4Y4Zr0.2 | Casting alloy | 1.0 | 90.5 | 248 | A | 2.05 |
| Example | 6 | Mg95.3Zn2Y2.5Zr0.2 | Casting alloy | 0.8 | 87.5 | 245 | A | 1.92 |
| Example | 7 | Mg95.3Zn2.5Y2Zr0.2 | Casting alloy | 1.25 | 88.8 | 237 | A | 1.93 |
| Comparative Example | 1 | Mg97.8Zn1Y1Zr0.2 | Casting alloy | 1.0 | 95.4 | 178 | B | 1.82 |
| Comparative Example | 2 | Mg96.6Zn1.2Y2Zr0.2 | Casting alloy | 0.6 | 78.5 | 234 | A | 1.87 |
| Comparative Example | 3 | Mg95Zn2.8Y2Zr0.2 | Casting alloy | 1.4 | 79.8 | 247 | A | 1.93 |
| Comparative Example | 4 | Mg95.8Zn2Y2Zr0.2 | Extruded alloy | 1.0 | 72.4 | 340 | B | 1.92 |

TABLE 1-continued

| | | Composition of each alloy (atomic %) | Alloy form | Zn/Y | Thermal conductivity (W/m · K) | Tensile strength (MPa, 200° C.) | Network structure form | Specific gravity |
|---|---|---|---|---|---|---|---|---|
| Comparative Example | 5 | ADC12 | Casting alloy | — | 92 | 238 | — | 2.7 |
| Comparative Example | 6 | AZ91D | Casting alloy | — | 51 | 165 | C | 1.8 |
| Comparative Example | 7 | WE54 | Casting alloy | — | 52 | 220 | A | 1.9 |

In example 1, the tensile strength at 200° C. was 222 MPa, and the high-temperature strength equivalent to the conventional aluminum alloy ADC12 (comparative example 5) and the heat-resistant magnesium alloy WE54 (comparative example 7) was obtained. In addition, in example 1, a thermal conductivity of 92.1 W/m·K substantially equal to the conventional aluminum alloy ABC 12 (comparative example 5) was indicated. As described above, as compared with the conventional commercial magnesium alloys AZ91D (comparative example 6) and WE54 (comparative example 7), the magnesium alloy of example 1 was significantly improved in thermal conductivity.

In example 3, the alloy was obtained by adding Zr without any change of the contents of Zn and Y in example 1. As shown in FIG. 3, the magnesium alloy of example 3 had a tensile strength of 240 MPa at 200° C., and the alloy having a higher strength than in example 1 was obtained. The magnesium alloy of example 3 had a tensile strength of 225 MPa at 250° C. It can be considered from the metal structures of FIG. 1 (example 1) and FIG. 2 (example 3) that in example 3, the fine structure was formed by the crystal grain miniaturization action of Zr, and thus the tensile strength higher than in example 1 was obtained.

FIGS. 1 and 2 show that the magnesium alloys of examples 1 and 3 had a structure in which the long-period multilayer structure phase (the strengthening phase A) of $Mg_{12}ZnY$ formed in the shape of a three-dimensional mesh was present. It can be considered that in examples 1 and 3, the tensile strength higher than in comparative example 6 (AZ91D) was obtained by the formation of the network form of the $Mg_{12}ZnY$ phase.

With respect to the Mg purity of the Mg mother phase, the structure of example 1 had a high purity of 98.8%, and the structure of example 3 had a high purity of 99.0%. On the other hand, in comparative example 7 (WE54), the Mg purity was so low as to be 89.1%. Since the mixed ingredients other than Mg were elements which were lower in thermal conductivity than Mg, it was shown that as the ingredients other than Mg were solid-soluble in the Mg mother phase to lower the Mg purity, the thermal conductivity was lowered. It can be considered that the difference in the Mg purity affected the difference in the thermal conductivity between examples 1 and 3 and comparative example 7.

In examples 2 to 5, the amounts of Zn and Y added when Zn/Y was 1 were changed from 1.5 atomic % to 2 atomic % to 3 atomic % and to 4 atomic %. As shown in table 1, as the amounts of Zn and Y added were increased, the ingredients other than Mg were increased, with the result that the thermal conductivity was lowered. Although the tensile strength was increased, a peak was indicated at 3 atomic % (example 4), and the tensile strength was lowered at 4% (example 5). As the amounts of Zn and Y added were increased, the specific gravity was increased, and a specific gravity of 2.05 was indicated at 4 atomic % (example 5). With consideration given to the weight reduction of the component and the increase of the cost by the addition of Y, it can be considered that the need for more than 4% of Zn and Y to be added is small.

In comparative example 1 in which Zn/Y was 1, although the thermal conductivity was such a high value as to be 95.4 W/m·K, the tensile strength was so low as to be 178 MPa. It is estimated that this was because the network form of the long-period multilayer structure phase of $Mg_{12}ZnY$ was not sufficiently formed by the amounts of Zn and Y added in comparative example 1.

Then, examples 6 and 7 in which Zn/Y was changed are compared with comparative examples 2 and 3. In examples 6 and 7, Zn/Y was respectively 0.8 and 1.25, and Zn/Y was displaced from 1. However, the thermal conductivity and the tensile strength in examples 6 and 7 were substantially equal to those of the aluminum alloy ADC12 (comparative example 5). On the other hand, in comparative examples 2 and 3, Zn/Y was respectively 0.6 and 1.4, and the tensile strength was substantially equal to the tensile strength in examples 6 and 7. However, the thermal conductivity in comparative examples 2 and 3 was less than 80 W/m·K, and was lower than the thermal conductivity in examples 6 and 7. The present inventor estimates that this is because when the degree to which Zn/Y was displaced from 1 was increased, extra alloy elements in the generation of the strengthening phase of $Mg_{12}ZnY$ were solid-soluble in the Mg mother phase to lower the Mg purity of the Mg mother phase, with the result that the thermal conductivity of the magnesium alloy itself was lowered.

In comparative example 4, a casting material was obtained by casting a magnesium alloy having the same composition as in example 1 of Patent Document 2, and thereafter the casting material was extruded to produce an extruded alloy. Although in the extruded alloy of comparative example 4, the tensile strength was increased to 340 MPa by the extrusion, the thermal conductivity was significantly lowered to 72.4 W/m·K. It can be considered that this is because added elements were diffused by thermal history at the time of extrusion and were thereby solid-soluble in the Mg mother phase or processing distortion was produced.

FIG. 3 is a graph showing variations in the tensile strength of the alloys in example 3 and comparative example 5 (ADC12 material) from room temperature to 250° C. As shown in FIG. 3, in the magnesium alloy of example 3, the high-temperature strength was equal to or more than the high-temperature strength in the aluminum alloy of comparative example 5.

Figure 4A:
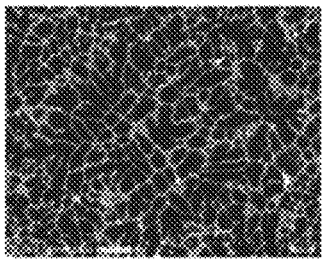
FIGS. 4A to 4C are electron micrographs showing the metal structure of the casting magnesium alloys in examples 3 to 5.
Figure 4B:
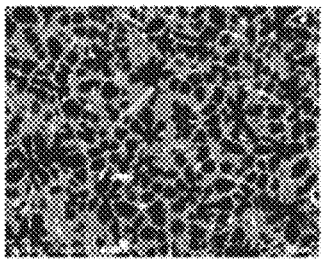
Figure 4C:
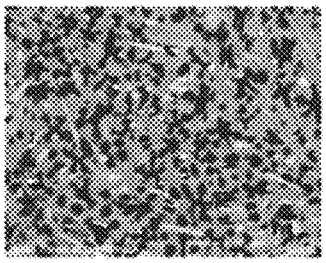
Figure 5:
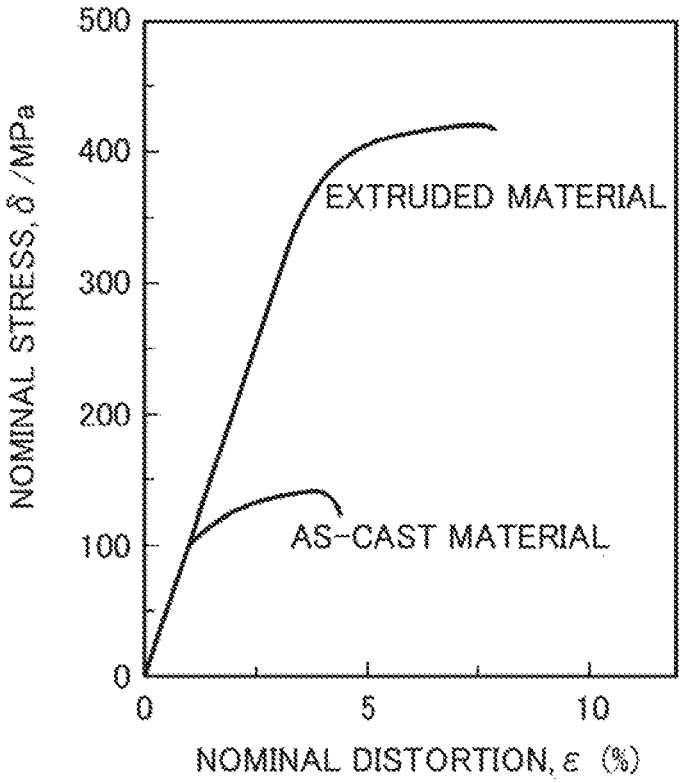
PRIOR ART FIG. 5
FIG. 5 is a graph showing a relationship of stress and distortion between an extruded material and an as-cast material.

FIGS. 4A to 4C are electron micrographs showing the metal structure of the casting magnesium alloys in examples 3 to 5. FIG. 4A shows the metal structure in example 3, FIG. 4B shows the metal structure in example 4 and FIG. 4C shows the metal structure in example 5. As shown in FIGS.

4A to 4C, the network form of the strengthening phase of $Mg_{12}ZnY$ crystallized was formed such that as compared with example 3 where 2 atomic % of Zn and 2 atomic % of Y were added, in example 4 where 3 atomic % was individually added and example 5 where 4 atomic % was individually added, the width of the strengthening phase of $Mg_{12}ZnY$ was increased. As described above, the amounts of Zn and Y added were increased, and thus the strengthening phase of $Mg_{12}ZnY$ was crystallized so as to have a larger width, with the result that the magnesium alloy had a higher strength.

EXPLANATION OF REFERENCE NUMERALS

A: strengthening phase (long-period multilayer structure phase of $Mg_{12}ZnY$)
B: Mg mother phase (crystal grain)

What is claimed is:

1. A magnesium casting alloy comprising Mg, Zn and Y,
wherein a content of Zn is at least 1.2 atomic % but no more than 4.0 atomic %,
a content of Y is at least 1.2 atomic % but no more than 4.0 atomic %,
a composition ratio Zn/Y of Zn to Y is at least 0.9 but no more than 1.1,
an Mg purity of an Mg mother phase is at least 97.0%, and
a thermal conductivity is at least 80.0 W/m·K.

2. A magnesium casting alloy comprising Mg, Zn and Y,
wherein a content of Zn is at least 1.2 atomic % but no more than 4.0 atomic %,
a content of Y is at least 1.2 atomic % but no more than 4.0 atomic %,
a composition ratio Zn/Y of Zn to Y is at least 0.9 but no more than 1.1,
a thermal conductivity is at least 80.0 W/m·K and
a tensile strength at 200° C. is at least 200 MPa.

3. A magnesium casting alloy comprising Mg, Zn and Y,
wherein a content of Zn is more than 3.0 atomic % and no more than 4.0 atomic %,
a content of Y is more than 3.0 atomic % and no more than 4.0 atomic % and
a composition ratio Zn/Y of Zn to Y is at least 0.9 but no more than 1.1.

4. The magnesium casting alloy according to claim 3, wherein a thermal conductivity is at least 80.0 W/m·K.

5. The magnesium casting alloy according to claim 3, wherein a tensile strength at 200° C. is at least 200 MPa.

6. The magnesium casting alloy according to claim 1, further comprising 0.01 atomic % or more but 0.3 atomic % or less of Zr.

7. The magnesium casting alloy according to claim 2, further comprising 0.01 atomic % or more but 0.3 atomic % or less of Zr.

8. The magnesium casting alloy according to claim 3, further comprising 0.01 atomic % or more but 0.3 atomic % or less of Zr.

9. The magnesium casting alloy according to claim 1, wherein a long-period multilayer structure phase of $Mg_{12}ZnY$ is formed in a shape of a three-dimensional mesh.

10. The magnesium casting alloy according to claim 2, wherein a long-period multilayer structure phase of $Mg_{12}ZnY$ is formed in a shape of a three-dimensional mesh.

11. The magnesium casting alloy according to claim 3, wherein a long-period multilayer structure phase of $Mg_{12}ZnY$ is formed in a shape of a three-dimensional mesh.

12. The magnesium casting alloy according to claim 1, wherein a specific gravity is equal to or less than 2.10.

13. The magnesium casting alloy according to claim 2, wherein a specific gravity is equal to or less than 2.10.

14. The magnesium casting alloy according to claim 3, wherein a specific gravity is equal to or less than 2.10.

15. A method of manufacturing the magnesium casting alloy according to claim 1, the method comprising:
cooling a molten metal material at a rate which is at least 20 K/second but no more than 200 K/second.

16. A method of manufacturing the magnesium casting alloy according to claim 2, the method comprising:
cooling a molten metal material at a rate which is at least 20 K/second but no more than 200 K/second.

17. A method of manufacturing the magnesium casting alloy according to claim 3, the method comprising:
cooling a molten metal material at a rate which is at least 20 K/second but no more than 200 K/second.

18. An engine member comprising the magnesium casting alloy according to claim 1.

19. An engine member comprising the magnesium casting alloy according to claim 2.

20. An engine member comprising the magnesium casting alloy according to claim 3.

21. The magnesium casting alloy according to claim 1,
wherein the Mg purity of the Mg mother phase is at least 98%, and
a thermal conductivity is at least 90.0 W/m·K.

22. The magnesium casting alloy according to claim 2,
wherein an Mg purity of an Mg mother phase is at least 98%, and
a thermal conductivity is at least 90.0 W/m·K.

23. The magnesium casting alloy according to claim 3,
wherein an Mg purity of an Mg mother phase is at least 98%, and
a thermal conductivity is at least 90.0 W/m·K.

* * * * *